US012089722B2

(12) United States Patent
You

(10) Patent No.: US 12,089,722 B2
(45) Date of Patent: Sep. 17, 2024

(54) LOAD REDUCING BACKPACKS

(71) Applicant: Huiyun You, Guangdong (CN)

(72) Inventor: Huiyun You, Guangdong (CN)

( * ) Notice: Subject to any disclaimer, the term of this patent is extended or adjusted under 35 U.S.C. 154(b) by 162 days.

(21) Appl. No.: 17/879,819

(22) Filed: Aug. 3, 2022

(65) Prior Publication Data

US 2023/0320476 A1 Oct. 12, 2023

(30) Foreign Application Priority Data

Apr. 6, 2022 (CN) ..... 202220794770.8

(51) Int. Cl.
*A45F 3/04* (2006.01)
*A45F 3/00* (2006.01)

(52) U.S. Cl.
CPC ..... *A45F 3/04* (2013.01); *A45F 2003/001* (2013.01)

(58) Field of Classification Search
CPC ..... A45F 2003/122; A45F 2003/125; A45F 2003/127
USPC ..... 224/642
See application file for complete search history.

(56) References Cited

U.S. PATENT DOCUMENTS 3,679,108 A * 7/1972 Ingram ..... A45F 3/04 224/644
4,350,726 A 9/1982 Berry, Jr.
5,573,155 A * 11/1996 Sadler ..... A45F 4/02 224/907
6,488,189 B1 12/2002 Smith
9,439,500 B2 * 9/2016 Smith ..... A01K 27/003
9,999,289 B2 6/2018 Bonnema et al.
10,070,712 B2 * 9/2018 Wronski ..... A45C 13/40
11,039,677 B2 6/2021 Clark et al.
11,528,982 B2 * 12/2022 Li ..... A45C 11/38
2004/0238303 A1 * 12/2004 Hafif ..... A45C 5/143 190/115
2010/0051657 A1 * 3/2010 Onessimo ..... A45F 3/04 224/642
2016/0316877 A1 * 11/2016 Mosee ..... A45C 13/1046

FOREIGN PATENT DOCUMENTS

CN 108741554 A * 11/2018
FR 2877820 A1 * 5/2006 ..... A45F 3/10
KR 200182797 Y1 * 5/2000

* cited by examiner

*Primary Examiner* — Scott T McNurlen

(57) ABSTRACT

A load reducing backpack comprises two shoulder straps, a main body and at least a cushion; the main body has a cavity, a back part of the cavity is provide with a back pad, a lower part of the back pad is provided with a mounting slot, the cushion is mounted disassembly in the mounting slot and attached to a front wall of the cavity; the load reducing backpack is carried on the user's back, the shoulder straps hang on the user's shoulders; adjust the length of the shoulder straps, so that the side, near to the back pad, of the cushion against the user's waist, thereby absorbing the pressure of the articles in the load reducing backpack and reducing the pressure on the user's back and the user's shoulders.

9 Claims, 4 Drawing Sheets

LOAD REDUCING BACKPACKS

FIELD OF THE INVENTION

The present invention relates to backpacks technical field, more particularly, to load reducing backpacks.

BACKGROUND OF THE INVENTION

Backpack is a general term for backpacks carried on both shoulders, used for containing articles such as books, foods and sundries, which are easy to carry, free of user's hands and provide a great convenience for people. Because of the above advantages, backpacks are becoming increasingly accepted and used.

Due to the unreasonably design of the existing backpack, when the backpack carrying articles is too heavy or is carried for a long time, the user's body, especially, the back and the shoulders, will be pressed, which will make the user feel tired and uncomfortable at shoulders and waist.

Therefore, it is necessary to design a reducing load backpack.

SUMMARY OF THE INVENTION

The object of the present invention is to provide a load reducing backpack, to solve the technical problems in the prior art that the backpacks carrying articles are too heavy or are carried for a long time, the user's body, especially, the back and the shoulders, will be pressed, which will make the user feel tired and uncomfortable at shoulders and waist.

In order to achieve the above object, the present invention provides a load reducing backpack, which includes two shoulder straps, a main body and at least a cushion; both ends of each of the two shoulder straps are mounted respectively on a top end or a low side of a rear surface of the main body; the main body has a cavity, a back part of the cavity is provided with a back pad, a lower part of the back pad is provided with a mounting slot, the cushion is mounted removably in the mounting slot and attached to a front wall of the cavity.

The cavity contains a mounting plate arranged above the mounting slot, a side of the mounting plate is fixed with an inner wall of the cavity, a bottom surface of the mounting plate attaches to the cushion in the mounting slot, a top surface of the mounting plate is provided rotatably with a plenty of soft plates.

The inner of the mounting plate is fixed with a plurality of elastic members.

The cushion comprises a straight plate and a curve plate, the straight plate is fixed with the curve plate, the curve plate is mounted in the mounting slot removably, the straight plate attaches to the front wall of the cavity.

The cushion comprises the straight plate and an edge plate, the straight plate is fixed with the edge plate, the edge plate is mounted in the mounting slot removably, the straight plate attaches to the front wall of the cavity.

The rear surface of the main body is provided with a plurality of elastic bulge particles, which are equidistant distributed.

The rear part of the main body is provided with a first cotton block, a second cotton block and a third cotton block. The first cotton block and the second cotton block are fixed above the rear part of the main body symmetrically; the third soft cotton block is fixed below the rear part of the main body.

The bottom part of the main body is provided with a thick plate, between which and the main body, there is a baffle.

The cavity contains a partition, which is fixed with the inner wall of the cavity and divides the cavity into a primary storage chamber and a secondary storage chamber.

The rear wall of the cavity is provided with an elastic network, a left side, a right side and a bottom side of the elastic network is fixed with the inner wall of the cavity to form a storage bag.

The above-described one or more of the technical solutions for the load reducing backpacks according to the embodiments in the present invention have at least one of the following technical effects:

The load reducing backpacks are carried on the user's back, the shoulder straps hang on the user's shoulders. Adjust the lengths of the shoulder straps, so that the side, near to the back pad, of the cushion against the user's waist, thereby absorbing the pressure of the articles in the load reducing backpacks and reducing the pressure on the user's back and the user's shoulders. The cushion is mounted in the mounting slot, the cushion and the back pad are perpendicular to each other to form a stable structure, which can support effectively the articles in the load reducing backpacks and disperse the pressure of the articles, thereby reducing the load on the user's shoulder and back, so that the user do not feel tired and discomfort. If the articles in the load reducing backpacks are too heavy, the users can also add a plenty of the cushions to improve the reducing load effect.

BRIEF DESCRIPTION OF THE DRAWINGS

In order to more clearly explain the technical scheme of the embodiment in the present invention, the drawings to be used in the embodiment or the prior art description will be simply introduced as follows. It is obviously, the following drawings are only some embodiments in the present invention, and for those skilled in the art, other drawings can be obtained without creative labour.

DETAILED DESCRIPTION OF ILLUSTRATED EMBODIMENTS

In order to make the invention purpose, the technical scheme and the technical effect more clearly be understood, the invention is further explained in combination with the concrete embodiment below. It should be understood that the specific embodiments described herein are only used to interpret the invention and are not used to limit the invention.

Embodiments of the present invention are described in detail below, and examples of the embodiments are shown in the attached drawings, in which the same or similar labels represent the same or similar elements or elements with the same or similar function. The embodiments described below by reference to the attached drawings are exemplary and are intended to explain embodiments of the present invention and cannot be understood as limits in the present invention.

In the description of the embodiments of the present invention, it should be understood that the directional indications involved in the embodiments, such as the "upper", "lower", "left", "right", "front", "rear", "internal" and "external", indicating orientation or location relationship, are based on the orientation or position relationship showed in the figures. These directional indications are only for describing the embodiments in the present invention and simplifying the description, rather than indicating or implying that the device or the element must be constructed and operated in a specified azimuth, which cannot be understood as a limitation of the present invention.

Further, the terms "first", and "second" are used only for description purposes, and cannot be understood as indicating or implying relative importance or implicitly indicating the number of technical features indicated. Thus, features defining "first" and "second" may expressly or implicitly include one or more of the features. In the description of the embodiments of the present invention, the "plurality of" means two or more unless otherwise specifically limits.

Figure 1:
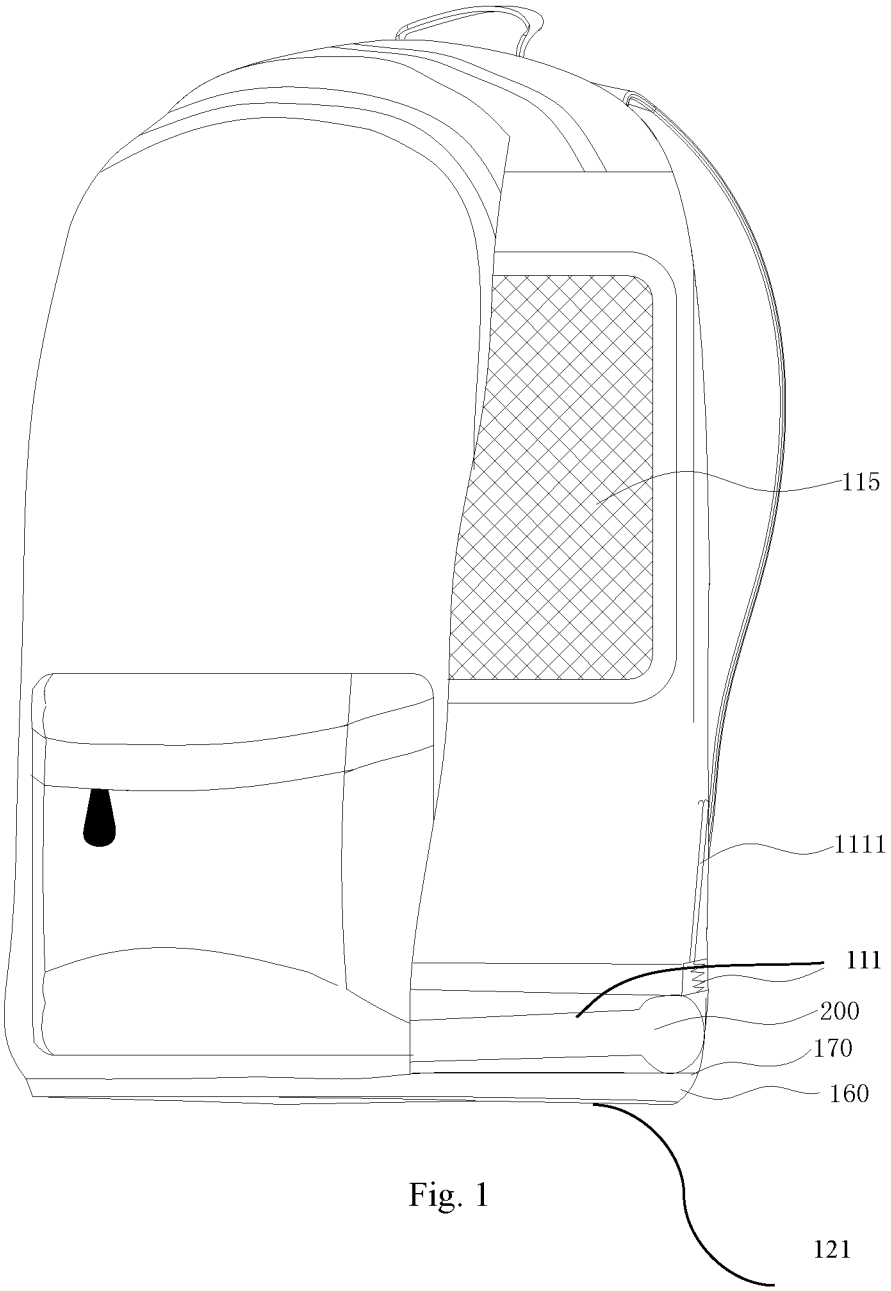
FIG. 1 is an in section view of the load reducing backpack according to the embodiment in the present invention.
Figure 2:
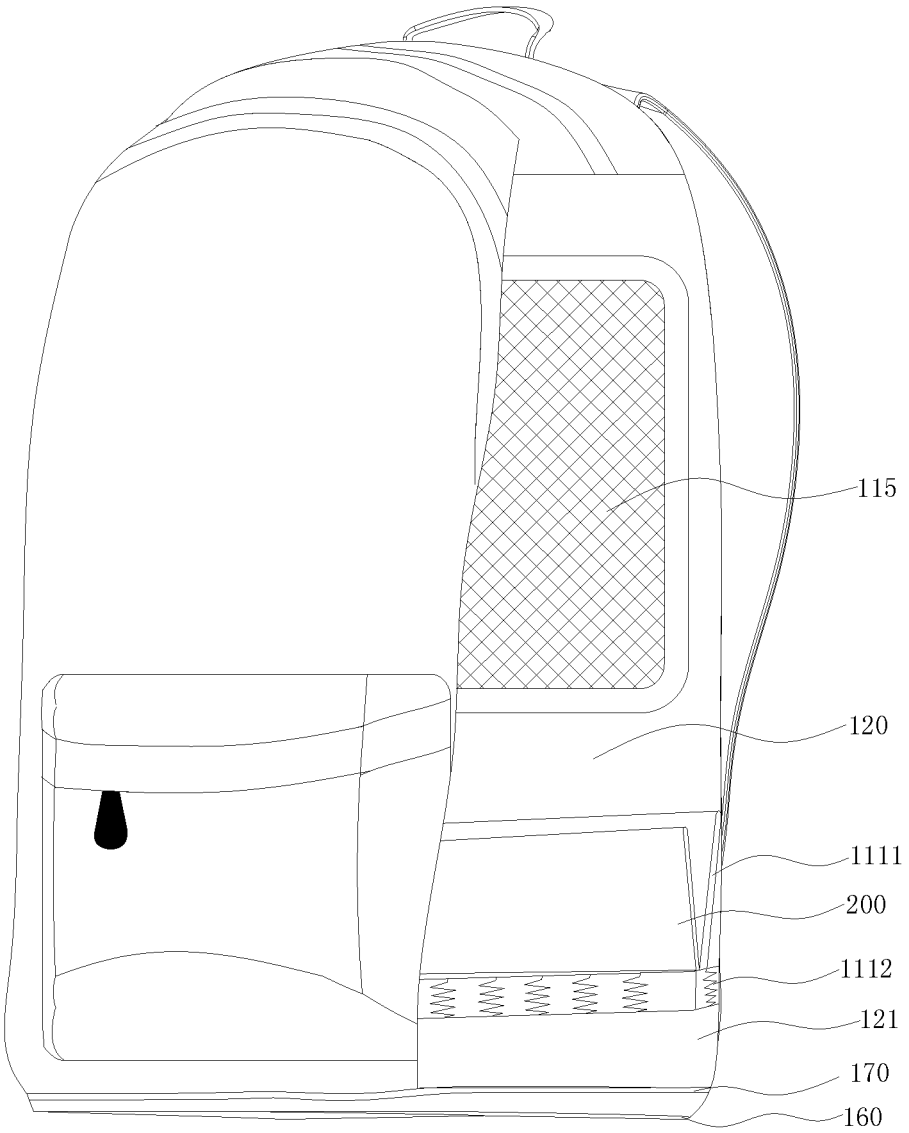
FIG. 2 is a perspective view of the load reducing backpack after removing the cushion showing in FIG. 1.

In some embodiments in the present invention, referring to FIG. 1 and FIG. 2, the present invention provides a load reducing backpack, which includes two shoulder straps 101, a main body 100 and at least a cushion 200. The main body 100 has a cavity 110, a back part of the cavity 110 is provided with a back pad 120, a lower part of the back pad 120 is provided with a mounting slot 121. The cushion 200 is mounted removably in the mounting slot 121 and attached to a front wall of the cavity 110.

The user carries the load reducing backpack on the his back, the shoulder straps 101 hang on the user's shoulders. Adjust the lengths of the shoulder straps 101, so that the cushion 200 attaches against the user's waist to form some gap between the back of the load reducing backpack and the user's back, thereby disperse the pressure of the load reducing backpack and the articles therein on the user's shoulder and the user's waist, and reducing the pressure on the user's back and the user's shoulders.

The cushion 200 is mounted in the mounting slot 121, the cushion 200 and the back pad 120 are perpendicular to each other to form a stable structure, which can support effectively the articles in the load reducing backpack and disperse the pressure of the articles, thereby reducing the load on the user's shoulder and back, so that the user do not feel tired and discomfort. If the articles in the load reducing backpack are too heavy, the users can also add a plenty of cushions 200 to improve the reducing load effect.

In the embodiment, the back pad 120 is sewn in the main body 100.

In some embodiments in the present invention, referring to FIG. 1 and FIG. 2, the cavity 100 contains a mounting plate 111 arranged above the mounting slot 121, a side of the mounting plate 111 is fixed with an inner wall of the cavity 120. When the cushion 200 is mounted in the mounting slot 121, a bottom surface of the mounting plate 111 attaches to the cushion 200, a top surface of the mounting plate 111 is provided rotatably with a plurality of soft plates 1111. The soft plates 1111 can hold some cards, keys, etc., which further enriches the types of stored articles of the cavity 110, and improving the practicality.

When the cushion 200 is mounted in the mounting slot 121, the mounting plate 111 can further press the cushion 200 so that the cushion 200 can not take off the mounting slot 121.

In some embodiments in the present invention, referring to FIG. 1 and FIG. 2, the inner of the mounting plate is fixed with a plurality of elastic members 1112. When one side of the cushion 200 is inserted into the mounting slot 121, the elastic members 1112 are pressed by the cushion 200, thereby applying an reverse force to the cushion 200 to fix it securely in the mounting slot 121, which enhances the pressing effect of the mounting plate 111 on the soft plates 1111.

In the embodiment, the elastic members 1112 are re linear compression spring.

Figure 3:
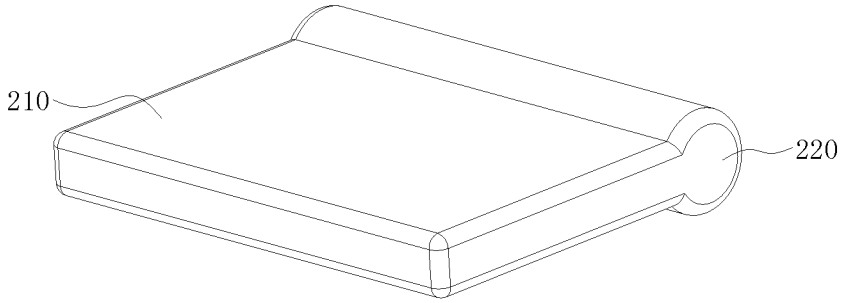
FIG. 3 is a perspective view of the cushion according to the embodiment in the present invention.

In some embodiments in the present invention, referring to FIG. 3, the cushion 200 comprises a straight plate 210 and a curve plate 220, the straight plate 210 is fixed with the curve plate 220, the curve plate 220 is mounted in the mounting slot 121 removably, the straight plate 210 attaches to the front wall of the cavity 110. Specifically, the straight plate 210 covers a whole bottom part of the load reducing backpack and plays the function of supporting the articles in it. The curve plate 220 is overfitting with the mounting slot 121. So that, when the curve plate 220 is mounted in the mounting slot 121, it is fixed therein, thereby fixing the cushion 200.

Figure 4:
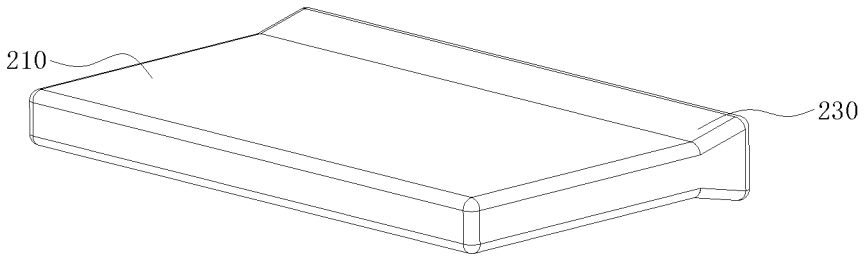
FIG. 4 is the other perspective view of the cushion according to the embodiment in the present invention.

In some embodiments in the present invention, referring to FIG. 4, the cushion 200 comprises a straight plate 210 and an edge plate 230 which are fixed together. The edge plate 230 is inserted into the mounting slot 121 removably. The straight plate 210 attaches to the front wall of the cavity 110. Specifically, the edge plate 230 is a triangle edge plate, mounted in the mounting slot 121, the edges of the edge plate 230 are coupled with the wall of the mounting slot 121 so that the cushion 200 is generally mounted within the cavity 110 securely.

Figure 5:
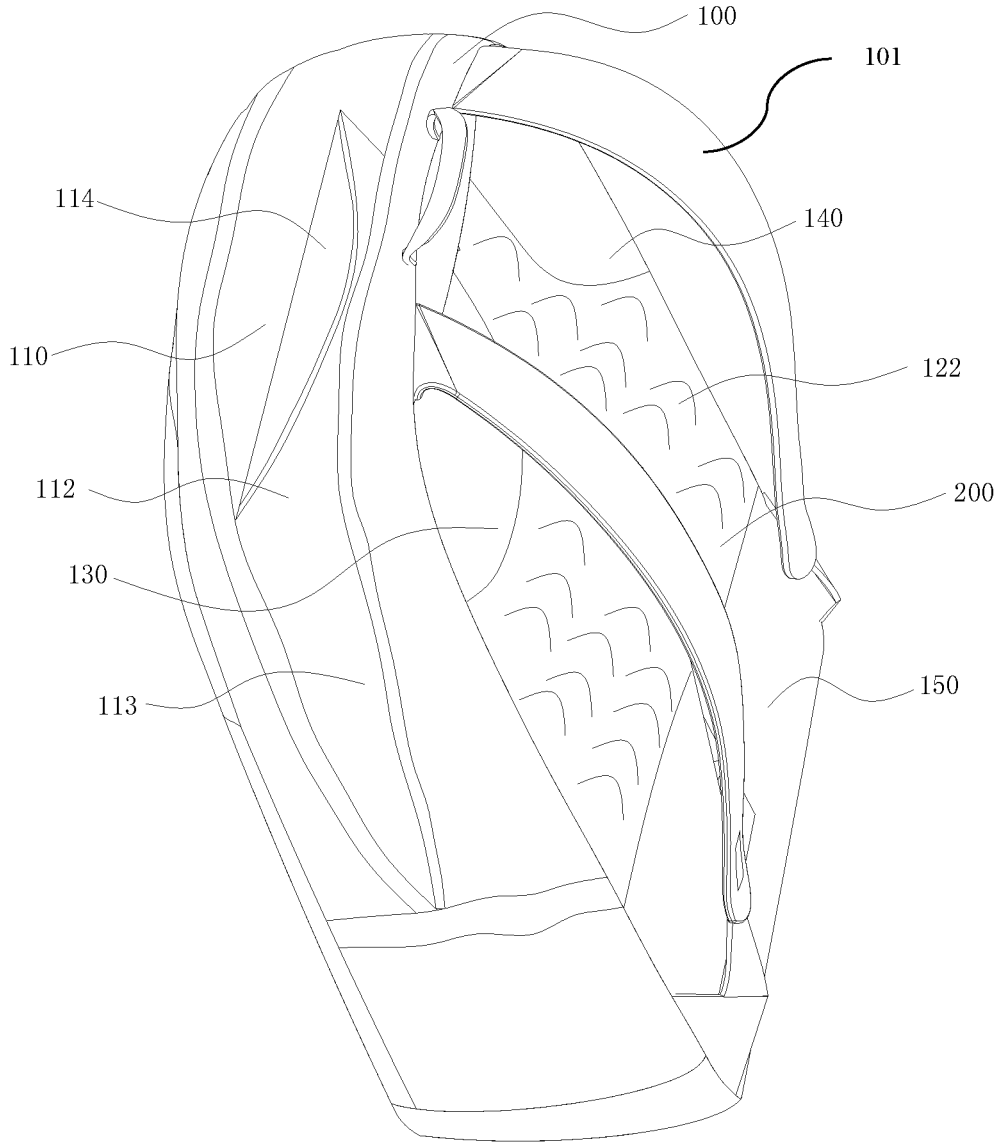
FIG. 5 is a perspective view of the load reducing backpack according to the embodiment in the present invention.

In some embodiments in the present invention, referring to FIG. 5, the surface of the back pad 120 is provided with a plurality of elastic bulge particles 122, which are equidistant distributed. Because of the existing of the elastic bulge particles 122, there is breathable space between the user's back and the back pad 120. The heat, generated by the friction of the user's back and the back pad 120, can be discharged outward through the breathable space. The reducing load bag has good air permeability, the users are not easy to sweat when carrying it.

In some embodiments in the present invention, referring to FIG. 5, the rear part of the main body 100 is provided with a first cotton block 130, a second cotton block 140 and a third cotton block 150. The first cotton block 130 and the second cotton block 140 are fixed above the rear part of the main body 100 symmetrically. Specifically, the first cotton block 130 and the second cotton block 140 are arranged a left side and a right side of the upper portion of the rear part of the main body 110.

When using, the first cotton block 130 and the second cotton block 140 attach tightly to the user's shoulders, which can disperse effectively the pressure on the user's shoulders, that is, to a certain extent to relieve the pressure on the user's shoulders, so that the user is not easy to feel tired. The third cotton block 150 is fixed the lower portion of the rear part of the main body 100, corresponding to the user's waist, and disperse the pressure on the waist of the user's waist effectively and reducing the pressure on the user's waist.

Figure 6:
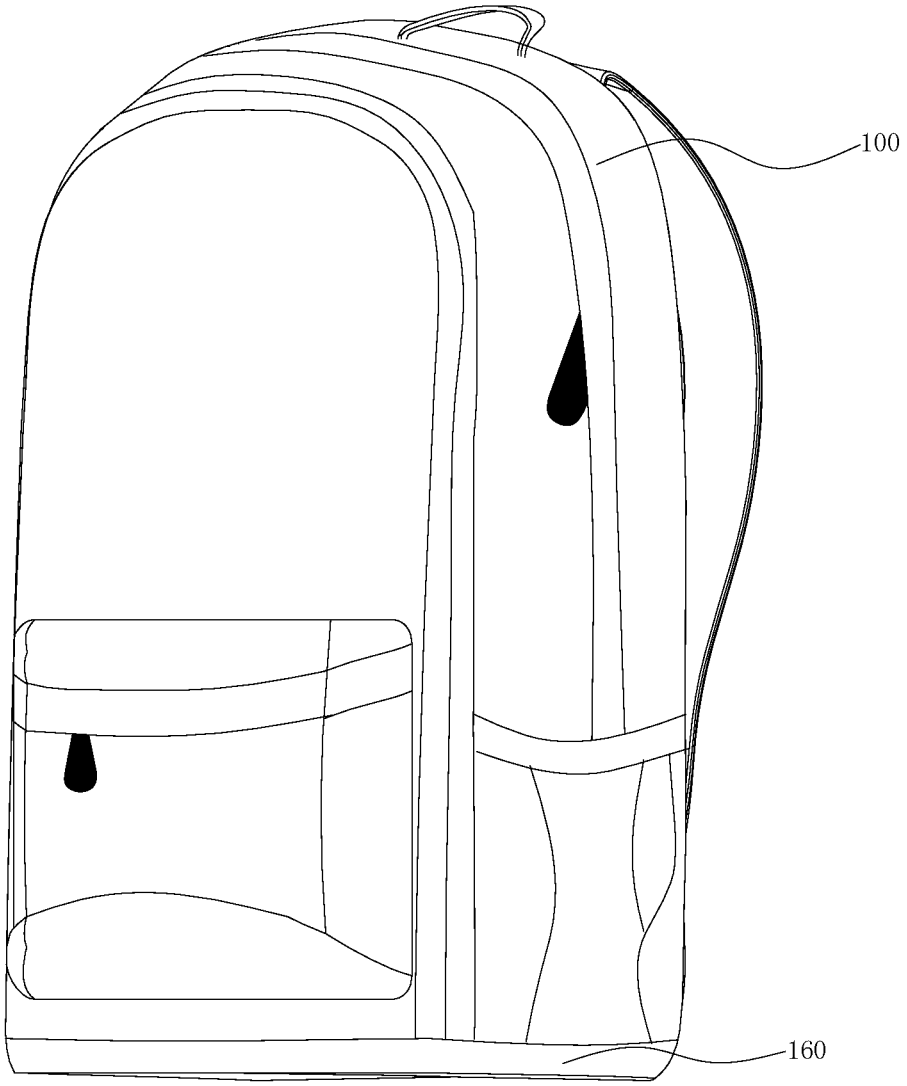
FIG. 6 is the other perspective view of the load reducing backpack at the other angle of view according to the embodiment in the present invention.

In some embodiments in the present invention, referring to FIG. 5 and FIG. 6, the bottom part of the main body 100 is provided with a thick plate 160, between which and the main body 100, there is a baffle 170. The thick plate 160 enhances the load capacity of the backpack and increases the capacity of the backpack.

The baffle 170 is made from plastics for shock-absorbing, if the backpack is hit accidentally, it provides certain protection.

In some embodiments in the present invention, referring to FIG. 5, the cavity 110 contains a partition 112, which is fixed with the inner wall of the cavity 110 and divides the cavity 110 into a primary storage chamber 113 and a secondary storage chamber 114. In the embodiments, one end of the partition 112 is fixed with the bottom of the cavity 110. The cavity 110 is divided into a plurality of storage layers, which facilitates the user to store articles according to the size, shape and facilitate the removal and release of articles.

In some embodiments in the present invention, referring to FIG. 1 and FIG. 2, the rear wall of the cavity 110 is provided with an elastic network 115, a left side, a right side and a bottom side of the elastic network 115 is fixed with the inner wall of the cavity 110 to form a storage bag. In this embodiment, the elastic network 115 is made of an elastic cloth, and can be used to collect and fix large and irregular articles.

The above-mentioned examples are only better embodiments of the present invention and are not used to limit the present invention. Any modification, equivalent replacement and improvement made within the spirit and principles of the present invention shall be included in the protection scope of the present invention.

What is claimed is:

1. A load reducing backpack, comprising two shoulder straps each with two ends, a main body and at least a cushion; said two ends of each of said two shoulder straps are mounted respectively on a top end or a low side of a rear surface of said main body; said main body has a cavity, a back part of said cavity is provided with a back pad, a lower part of said back pad is provided with a mounting slot, said cushion is mounted removably in said mounting slot and attached to a front wall of said cavity;

wherein said cavity contains a mounting plate arranged above said mounting slot, a side of said mounting plate is fixed with an inner wall of said cavity, a bottom surface of said mounting plate attaches to said cushion in said mounting slot, a top surface of said mounting plate is provided rotatably with a plurality of soft plates.

2. The load reducing backpack according to claim 1, wherein an inner of said mounting plate is fixed with a plurality of elastic members.

3. The load reducing backpack according to claim 1, wherein said cushion comprises a straight plate and a curve plate, said straight plate is fixed with said curve plate, said curve plate is mounted in said mounting slot removably, said straight plate attaches to said front wall of said cavity.

4. The load reducing backpack according to claim 1, wherein said cushion comprises a straight plate and a edge plate, said straight plate is fixed with said edge plate, said edge plate is mounted in said mounting slot removably, said straight plate attaches to said front wall of said cavity.

5. The load reducing backpack according to claim 4, wherein said rear surface of said main body is provided with a plurality of elastic bulge particles, which are equidistantly distributed.

6. The load reducing backpack according to claim 4, wherein a rear part of said main body is provided with a first cotton block, a second cotton block and a third cotton block; said first cotton block and said second cotton block are are fixed above said rear part of said main body symmetrically; said third soft cotton block is fixed below said rear part of said main body.

7. The load reducing backpack according to claim 4, wherein said bottom part of said main body is provided with a thick plate, between said thick plate and said main body, there is a baffle.

8. The load reducing backpack according to claim 4, wherein said cavity contains a partition, which is fixed with said inner wall of said cavity and divides said cavity into a primary storage chamber and a secondary storage chamber.

9. The load reducing backpack according to claim 8, wherein a rear wall of said cavity is provided with an elastic network, a left side, a right side and a bottom side of said elastic network is fixed with said inner wall of said cavity to form a storage bag.

* * * * *